US005884942A

United States Patent [19]

Raja

[11] Patent Number: 5,884,942

[45] Date of Patent: Mar. 23, 1999

[54] SECURITY AND IDENTIFICATION DEVICE

[76] Inventor: Yogendra K. Raja, 17 Baysdale Avenue, Bolton BL3 2XP, Lancashire, United Kingdom

[21] Appl. No.: 605,204

[22] PCT Filed: Mar. 2, 1995

[86] PCT No.: PCT/GB95/00456

§ 371 Date: Aug. 29, 1996

§ 102(e) Date: Aug. 29, 1996

[87] PCT Pub. No.: WO95/23708

PCT Pub. Date: Sep. 8, 1995

[30] Foreign Application Priority Data

Mar. 3, 1994 [GB] United Kingdom ..... 9404068

[51] Int. Cl.[6] ..... B42D 15/00

[52] U.S. Cl. ..... 283/75; 285/74; 285/70

[58] Field of Search ..... 283/70, 69, 81, 283/75, 77, 78, 98, 74, 117

[56] References Cited

U.S. PATENT DOCUMENTS 3,258,277 6/1966 Schuster ..... 283/57 X
4,469,937 9/1984 Stockburger ..... 235/435

FOREIGN PATENT DOCUMENTS 295657 8/1928 United Kingdom ..... 283/77

*Primary Examiner*—Willmon Fridie, Jr.
*Attorney, Agent, or Firm*—William H. Holt; William R. Hinds

[57] ABSTRACT

There is described a security device 10 and a method for verifying the identity of a person making a transaction. The security device 10 comprises a document 12 bearing a picture of the intended user 14 of the security device 10, the picture 14 having been produced by printing of picture 14 by a printer activated by computer memory in which a likeness of the intended user is stored. The devices 10 may be self adhesive for attachment to a second document and be provided in a form comprising a plurality of such devices.

10 Claims, 2 Drawing Sheets

SECURITY AND IDENTIFICATION DEVICE

The present invention relates to a security device for identifying a person making a transaction and to a method of verifying the identity of a person making a transaction.

Many financial transactions are nowadays carried out by means of cheques with guarantee cards, store cards or credit cards of various kinds. Hereinafter, all such cards will be referred to as credit cards. Mostly, the only means of identification that the credit card actually belongs to the person making the transaction is the apparent correspondence between the signatures on the credit card and that made by the person on the transaction slip at the point of sale, for example. Where credit cards have been stolen from the owner, it is relatively easy for a criminal to forge a signature to obtain goods or cash. However, not only are signed credit cards stolen from individuals, but also unsigned credit cards are intercepted by criminals between the source of the credit card and the person to whom they are being issued. Thus crime is even easier as there is no signature to copy.

Huge sums of money are lost each year by this form of fraudulent use of credit cards.

The use of fingerprints taken at the time of a transaction as a unique identifying feature has been proposed. Systems to include a persons finger print on a credit card and electronic finger print readers at the point of transaction or sale to check correspondence of finger prints between card and person have been proposed. Such systems do not appear to actually be in use owing to the tremendous technical complexity and cost involved. There are considerable technical problems involved with the storing and reading of fingerprints such as to make this method impractical, uneconomic and unpopular. Furthermore, there is great public resistance to such schemes.

Other proposals have been made to produce credit cards or identity cards having a likeness of the user thereon. However, such cards can be fraudulently produced and, when used in a transaction, are subsequently taken away by the user, thus, no evidence of the user remains with any of the transaction documents or with the victim of the crime.

It is an object of the present invention to provide a security device which is economic, does not have great technical complexity and does not involve the use of fingerprints and consequently does not have the same widespread public resistance to its use.

According to one aspect of the present invention there is provided a security identification device for verifying the identity of a person, the device comprising a first document bearing at least a likeness of said person, said first document being adapted to be permanently attached to a second document.

According to another aspect of the present invention there is provided a security identification device, the device comprising a first document bearing a likeness of the intended user of the security device, said likeness having been produced by printing of said likeness by printer means activated by computer memory means in which said likeness of the intended user is stored, said document being adapted for attachment to a second document.

According to a further aspect of the present invention, there is provided a method of verifying the identity of a person, the method comprising the steps of storing at least a likeness of said person in computer memory means said likeness being printed from said computer memory means on to a first document which is adapted to be attached to a second document, visual correspondence between said likeness on said first document and said person being assessed when said first document is attached to said second document.

The likeness may be produced and stored in the computer memory means by viewing the person or intended user by video camera or by scanning of a photograph of the person or intended user with a scanning device connected to a computer for example.

The likeness may be monochrome or colour.

It is possible with modern technology to produce high quality reproductions of photographs by scanning and storing the results of such scanning in computer memory means for printing by high speed printing means such as a laser printer or ink jet printer. The cost of printing personal security identification devices can thus be very low. The provision of such a security device would allow a sales person, for example, at the point of sale to easily confirm that the person making the transaction was entitled to be in possession of the devices and a credit card to which they may relate. Unless there is good visual correspondence between the likeness on the security device and the person actually making the transaction at the point of sale, the transaction will not proceed.

Because of the ease and speed with which such pictures may be produced, it would be cost effective to update the computer record of the user on a regular basis to allow for changes in appearance caused by age or fashion for example. The computer picture of the person may be stored with other data relating to that person and may be available on-line to, for example, a VDU monitor at the point of sale or in a bank and be triggered by an associated credit card, cheque guarantee card, payment card or whatever other magnetically activated means of payment the user were to proffer.

In one embodiment of the present invention, the device comprises a first document which is adapted to be affixed to a second document such as a record of a financial transaction, for example. Examples of the latter type of document may include a credit card transaction slip in a shop or the withdrawal of money by cheque at a bank, for example. The device may be adapted to be affixed to another document by the provision of an adhesive surface to the device, for example.

The device may also include other data relating to the person, such as address, bank details, a facsimile of their signature or any other desired data. Some or all of such additional data may be magnetically encoded on said device.

The device may be provided in the form of a "book" having a plurality of the devices therein. The devices may be provided as a book of "peel off" documents having a self-adhesive property for attachment to other documents. Alternatively, the devices may be included in a book or folder separated from each other or joined to a spine by perforations and may have an adhesive which requires moistening to activate.

Where the device is attached to another document, the person's signature may span the junction between the device and the document to which the device is attached.

A particular advantage of the present invention is that a likeness or picture of the person making the transaction remains with the provider of the goods or services. Thus, if a crime or fraud has been committed, there is a much greater likelihood of being able to eventually trace the person. This is true even if a considerable time elapses between the crime being committed and it being recognised as such.

Although examples have been given above of financial transactions such as the purchasing of goods or withdrawing money, it is intended that the device according to the present invention has far wider application than merely such transactions. It is intended that the device according to the present invention may be used wherever it is required that the identity of the user should be verified. Examples may include the cashing of welfare benefit cheques or attachment to or incorporation in a driving licence for example. Indeed, this is a further particular advantage of the present invention in that it is extremely versatile enabling the receiver to verify the persons identity in whatever transaction is being conducted.

The device comprises an area bearing a likeness of the person and may also comprise an area for receiving at least a part of the signature of the person, an area for receiving information about the particular transaction such as the date, value or any other pertinent information, an area bearing personal data such as a specimen signature for example.

Digitally stored visual images of a person may be analysed by computer means. Therefore, if a digital image of a person were stored on computer with, for example, his National Insurance number in the case of the United Kingdom, then if one or the other is known, i.e., his picture on a transaction document by means of the security identification device of the present invention, the other data relating to that person may be found by computer analysis of the picture. It should be understood that such computer analysis is also able to "strip away" disguises which people may apply so as to reveal the true underlying identity of the person. Thus, the person who leaves even a disguised picture of himself on a transaction document is eventually likely to be traced.

Clearly, in other countries, identifying data other than a UK National Insurance number may be used.

It is intended that the devices of the present invention are permanently attached to a second, or transaction document.

In order that the present invention may be more fully understood, examples will now be described by way of illustration only with reference to the accompanying drawings, of which:

Figure 1:
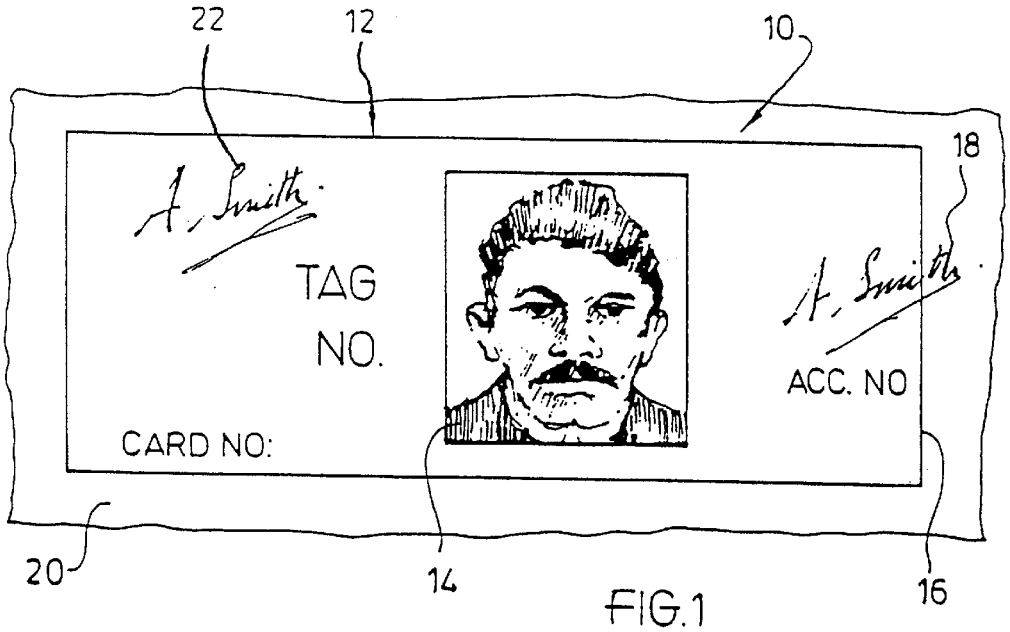
FIG. 1 shows a first embodiment of a device according to the present invention.

Referring now to FIG. 1 and where a first embodiment of a security identification device is shown generally at 10. The device comprises a document 12 which has an adhesive layer (not shown) on its reverse side, the adhesive layer possibly being protected by a peel-off backing sheet (not shown). On the document 12 is printed a likeness 14 of the intended user. The device may be permanently attached to a credit card transaction document or to a cheque for example at the time of making a transaction. The user may sign the device such that his/her signature spans the junction 16 of the device and the document 20 (indicated in part only by wavy line) to which it is attached as indicated at 18.

Figure 4:
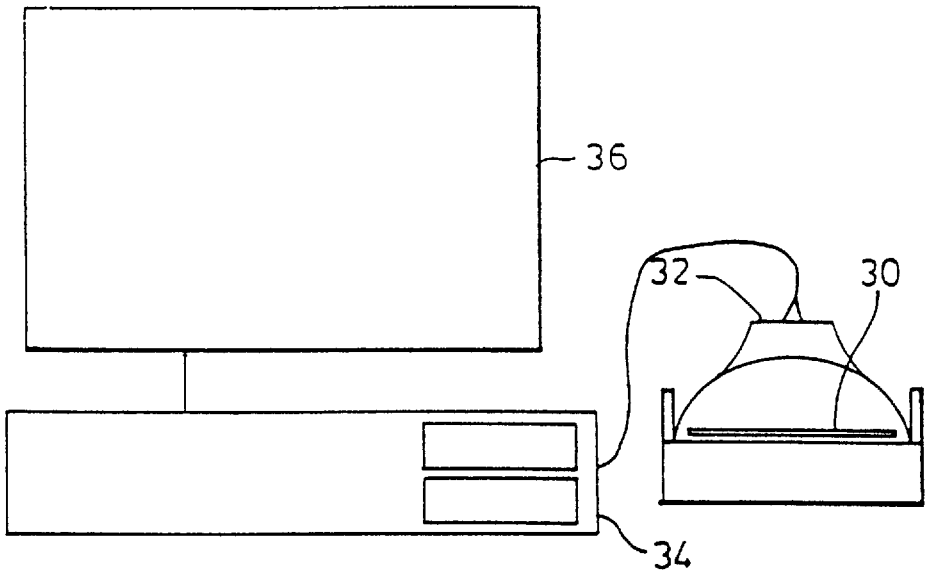
FIG. 4 shows a schematic representation for producing a device according to the present invention from a photograph.
Figure 5:
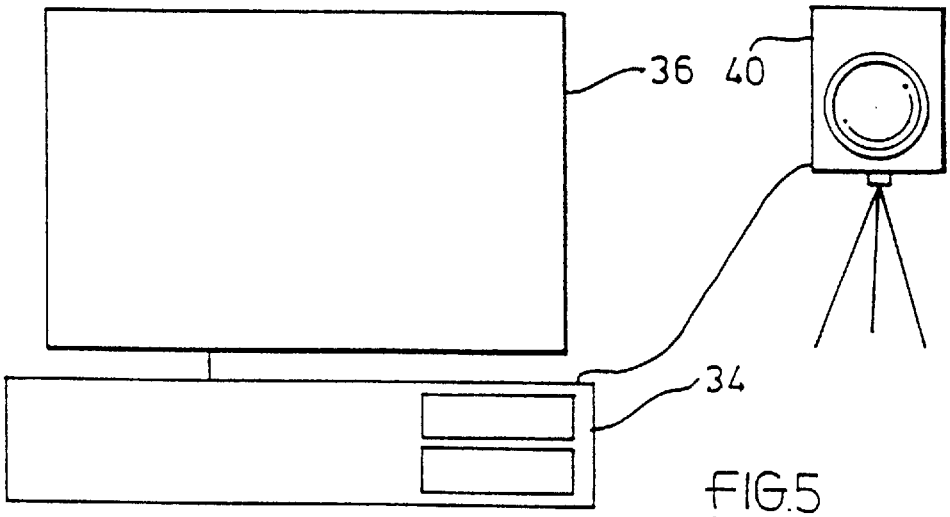
FIG. 5 shows a schematic representation for producing a device according to the present invention with a video camera.

The likeness at 14 in FIG. 1 may be produced according to either of the methods represented schematically at FIGS. 4 or 5.

In FIG. 4, a recent photograph 30 of the user is placed in a scanning device 32 which is linked to computer 34 which is in turn linked to a printer 36 schematically shown in the drawings. Once stored in the computer 34, security devices according to that described above with reference to FIG. 1 may be rapidly and economically printed together with any required personal data relating to the user in known manner.

In FIG. 5, the scanning device 32 is replaced by a video camera 40 for viewing the intended user or person, the camera being similarly linked to a computer 34 and schematically shown printer 36.

In similar manner, the computer which stores the digital representation of the user's likeness 14 may also store a digital representation of a specimen of the user's signature which may be included in the device 10 and indicated at 22 in FIG. 1.

Figure 2:
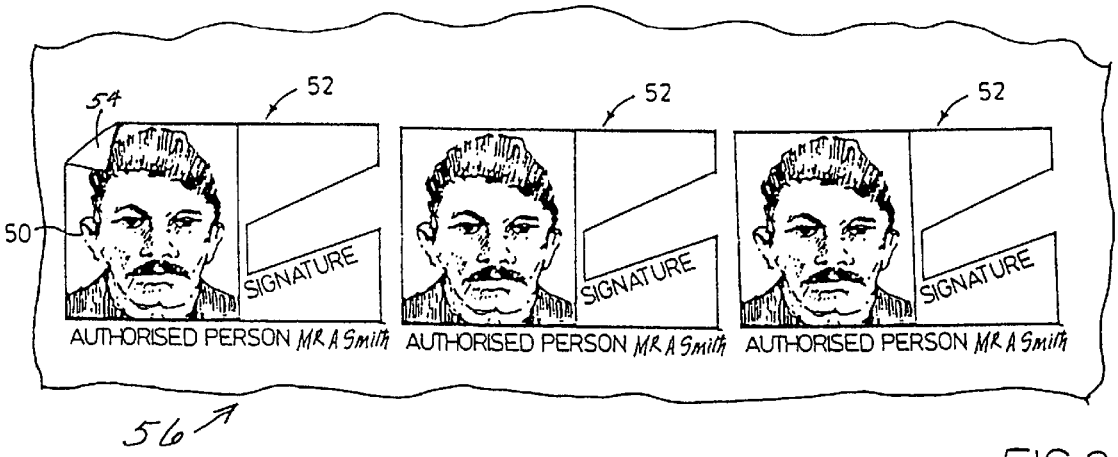
FIG. 2 shows a second embodiment of a device according to the present invention.

FIG. 2 shows a basic form of device according to the present invention and comprises a computer generated likeness 50 which could be used for example on the records held by hospitals or chemists in order to assist in preventing medicines being given to the wrong people, or in Government Department records relating to welfare and benefit claimants. The device 52 may have any or all of the features of the device shown in FIG. 1 or as hereinbefore described.

Figure 3:
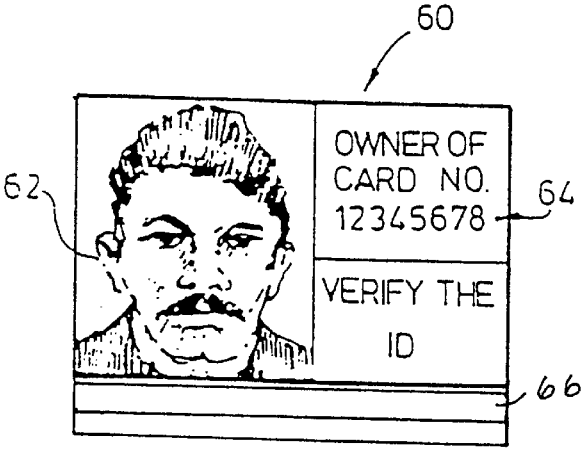
FIG. 3 shows a third embodiment of a device according to the present invention.

FIG. 3 shows a device 60 which could be issued by credit card companies or banks for example. The device includes a likeness 62 and the number 64 of the relevant credit card or guarantee card to which the device relates and magnetically encoded data 66.

It is believed that the security device would greatly reduce the amount of spontaneous crime currently perpetrated by thieves who steal credit cards and use them quickly before the card can be cancelled by the credit card company. The requirement that the card be used in conjunction with a device such as shown in FIG. 3, for example, would greatly reduce the level of this type of crime.

In some types of transactions, it would further improve security if the one of the types of security devices described above were attached to a transaction document by both parties, i.e. the person receiving goods, services or money, for example, and the person supplying same. This would serve to reduce the possibility of collusion between receiver and supplier.

All of the devices shown in FIGS. 1 to 3 may be provided in the form of a book, the devices comprising the pages and able to be peeled off a backing or torn along a perforated line. The devices can be self adhesive or have an adhesive which needs to be moistened to activate for example. The devices may alternatively be provided on a sheet in the form of peel off stamps or in any convenient form. Thus, FIG. 2 shows part of a sheet 56 bearing a plurality of identical first documents in the form of peel-off stamps, a corner of one stamp being turned to expose the underlying adhesive layer 54.

Figure 6:
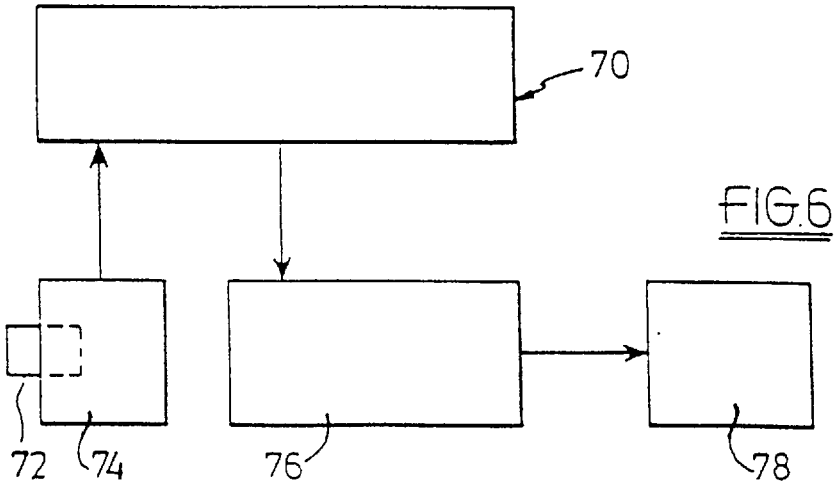
FIG. 6 which shows a schematic representation of a method according to the present invention of verifying the identity of a person.

FIG. 6 shows a schematic representation of apparatus for carrying out a method of verifying the identity of a person making a transaction. A computer is shown at 70, the computer being a central data base of, for example, a credit card company and containing the details of its customers including a computer generated likeness such as might be produced as shown with reference to FIGS. 4 or 5. When conducting a transaction, the purchaser (not shown) would present his/her credit card 72 to the sales person (not shown) who would insert the card 72 into a card reading device 74 linked to the computer 70. The computer 70 would then transmit information, including a likeness appropriate to the card account in question, to a terminal 76 at the site where the transaction is being conducted. The recorded likeness is then displayed on a VDU monitor screen 78 whereupon the sales person can compare the purchaser with the displayed likeness and confirm or otherwise that the purchaser is the authorised holder of the card.

As known in the computer art, the devices 74, 76 and 78 may all be comprised in one piece of apparatus but, may nevertheless carry out the functions described.

A particular advantage of the kind of computer stored likenesses envisaged herein is that the size of the image may be increased or reduced at will so that particular features may be examined in detail, thus facilitating recognition.

I claim:

1. A security identification device for verifying the identity of a person at the time of a transaction, the security identification device comprising a plurality of identical first documents, each of said first documents bearing: a picture of said person; identification data relating to said person or to a means of payment proffered by said person during said transaction; the person's name; and, an area to receive at least a part of the person's written signature; said first document, in use, being adapted to be permanently attached to a second document by an adhesive layer on said first document; said first documents being individually detachable from said security identification device for permanent application to different said second documents, each at the time of a different transaction.

2. A security identification device according to claim 1 wherein the device is in the form of a book having a plurality of pages bearing a plurality of first documents for detachment therefrom.

3. A security identification device according to claim 1 wherein the identification data relates to one of; a credit card; bank account; personal data.

4. A security identification device according to claim 1 wherein each first document also bears a facsimile of the person's signature.

5. A security identification device according to claim 1 wherein said data is magnetically encoded on each of said first documents.

6. A security identification device according to claim 1 wherein said picture is printed directly onto said first document.

7. A method of verifying the identity of a person and preventing fraud at the time of a transaction, the method comprising the steps of: preparing a security identification device comprising a plurality of identical first documents, each of said first documents bearing a picture of said person, identification data relating to said person or to a means of payment proffered by said person during said transaction, the person's name, and, an area to receive at least a part of the person's written signature; providing means for said first document to be permanently attached to a second document by applying an adhesive layer on said first document, said first documents being individually detachable from said security identification device for permanent application to different said second documents, each at the time of a different transaction; applying one of said first documents to a said second document; assessing visual correspondence between said picture and said person; and, allowing said first document attached to said second document to remain with a person supplying goods or services in said transaction after said transaction is completed.

8. A method according to claim 7 wherein said data or the picture may also be displayed on a VDU monitor at or adjacent a site where said transaction is being conducted.

9. A method according to claim 7 wherein the picture is produced from data stored in computer memory, said data having been supplied to the computer by a video camera viewing the person or by a scanning device scanning a photograph of the person.

10. A method according to claim 7 wherein the picture is a color picture.

* * * * *